US006315551B1

(12) United States Patent
Salzsieder et al.

(10) Patent No.: US 6,315,551 B1
(45) Date of Patent: Nov. 13, 2001

(54) BURNERS HAVING AT LEAST THREE AIR FEED DUCTS, INCLUDING AN AXIAL AIR DUCT AND A ROTARY AIR DUCT CONCENTRIC WITH AT LEAST ONE FUEL FEED, AND A CENTRAL STABILIZER

(75) Inventors: Patrick Salzsieder, Frankfurt; Gerhard Endres, Wiesbaden, both of (DE); Roland Guiot, Marseilles (FR)

(73) Assignee: Entreprise Generale de Chauffage Industriel Pillard (FR)

( * ) Notice: Subject to any disclaimer, the term of this patent is extended or adjusted under 35 U.S.C. 154(b) by 0 days.

(21) Appl. No.: 09/566,830

(22) Filed: May 8, 2000

(51) Int. Cl.[7] ..... F23D 14/24

(52) U.S. Cl. ..... 431/183; 239/424; 239/424.5; 239/400; 239/406

(58) Field of Search ..... 431/284, 182, 431/183, 188; 110/261, 262; 239/424, 424.5, 425, 400, 406

(56) References Cited

U.S. PATENT DOCUMENTS

| | | | | |
|---|---|---|---|---|
| 3,147,795 | * | 9/1964 | Livingston et al. | 431/284 |
| 4,208,180 | | 6/1980 | Nakayasu et al. . | |
| 4,679,512 | | 7/1987 | Skoog . | |
| 5,090,339 | * | 2/1992 | Oikura et al. | 431/284 |
| 5,178,533 | * | 1/1993 | Collenbusch | 431/284 |
| 5,878,676 | * | 3/1999 | Jochem et al. | 110/262 |
| 6,116,171 | * | 9/2000 | Oota et al. | 431/284 |

FOREIGN PATENT DOCUMENTS

| | | | | |
|---|---|---|---|---|
| 3823599 | * | 1/1990 | (DE) | 431/182 |
| 0421903 | | 4/1991 | (EP) . | |
| 1537037 | | 12/1978 | (GB) . | |
| WO9840668 | | 9/1998 | (WO) . | |

* cited by examiner

*Primary Examiner*—Sara Clarke
(74) *Attorney, Agent, or Firm*—Bachman & LaPointe, P.C.

(57) ABSTRACT

The technical field of the invention is making a burner capable of using one or more fuels, optionally simultaneously, together with particular features for the gas feed ducts. Such a burner comprises at least four substantially concentric ducts for feeding fuel and primary combustion air, including a duct for axial air and a duct for rotary air disposed outside any fuel outlet opening, and a central stabilizer placed at the outlet of a central primary air delivery duct opening out through orifices of said stabilizer, which stabilizer projects radially relative to any opening of a tube placed inside said central primary air duct and inside which a fuel pipe opens out. According to the invention, said burner has at least one additional gas feed opening out into said stabilizer and disposed around said opening having any diameter lying between the tube within which the fuel pipe opens out and the outer tube defining the central primary air delivery duct.

16 Claims, 6 Drawing Sheets

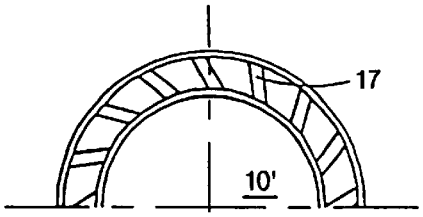
FIG. 7A
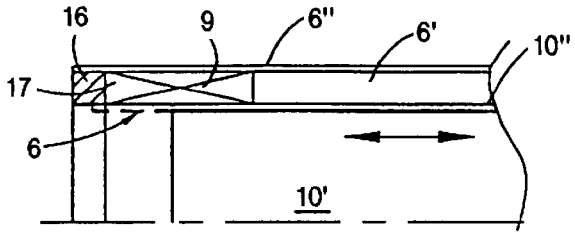
FIG. 7B
FIG. 8B
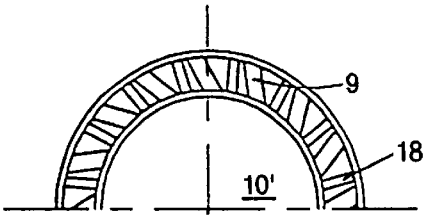
FIG. 8A
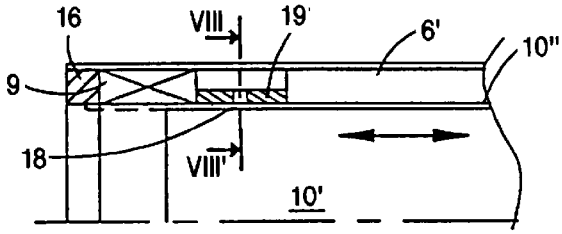
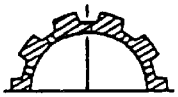
FIG. 8C
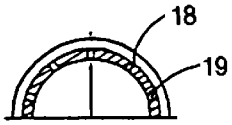
FIG. 8D
FIG. 9A
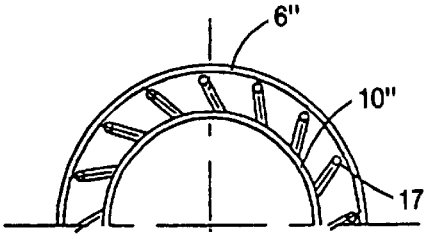
FIG. 9B
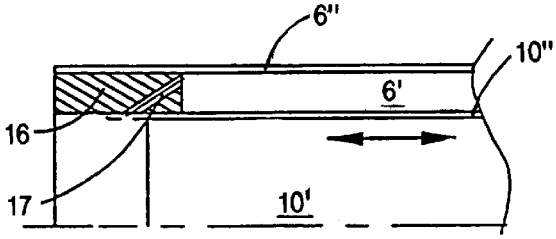

BURNERS HAVING AT LEAST THREE AIR FEED DUCTS, INCLUDING AN AXIAL AIR DUCT AND A ROTARY AIR DUCT CONCENTRIC WITH AT LEAST ONE FUEL FEED, AND A CENTRAL STABILIZER

The present invention is an improvement to burners having at least three air feed ducts, including an axial air duct and a rotary air duct concentric with at least one fuel feed, and a central stabilizer.

The technical field of the invention is making a burner capable of using one or more fuels, simultaneously or otherwise, with particular arrangements of the gas feed ducts, which gas can be air or a fuel gas.

BACKGROUND OF THE INVENTION

The main application of the invention is for use in burners for a rotary tubular furnace in which at least 80% of primary combustion air is delivered via at least two concentric ducts disposed around any fuel feed duct and via a third, central feed duct into which the remaining not more than 20% of the primary air is injected.

In a preferred embodiment, of said two concentric annular ducts feeding said burners with at least 80% of their primary air, one of them feeds the air in the form of a swirling current of air having peripheral flow components, and the other feeds air in the form of an axial flow having flow components that are substantially axial; said two primary air flow ducts are thus disposed radially outside any fuel duct, and in particular at least one annular duct for feeding pulverized coal; the central duct inside which at least one fuel feed pipe is slid, at least for starting purposes, is partially obstructed by a flame stabilizer in the form of a flange surrounding the central opening into which said pipe opens out, and has openings for passing a portion of the primary combustion air, i.e. said not more than 20%, and even in fact not more than 10% of the primary air, in such a manner that in the central zone situated downstream from said stabilizer no significant combustion of the fuel takes place, such that said central zone can be said to be "dead"; such a burner is described and claimed in European patent 421 903 published on Apr. 10, 1991 and filed by the same Applicant as for the present invention.

The present invention can be considered as being an improvement applied to such burners and more generally to any burner that can be considered as being a "modern" burner, having fuel and combustion air feed ducts in the above-defined main application, which ducts form a nozzle assembly for mounting on an-orifice provided for that purpose in the wall of an enclosure forming the hearth of the furnace or combustion chamber, and around which secondary air is delivered.

OBJECTS AND SUMMARY OF THE INVENTION

The object of the present invention is to avoid having a central zone at the outlet from said central primary air feed duct that is too reducing for the fuel because only 20% at most or even only 10% of the primary air is injected into said zone; this small proportion of the air (which proportion is adjustable) makes it possible, as described in the above-referenced prior patent, to obtain a wider range over which the operating rate of the burner can be adjusted by moving the beginning of combustion and the flame to a greater distance ahead of the center of the burner nozzle compared with methods and burners known prior to patent EP 421 903.

In the invention, the above object is obtained by enriching the air and fuel mixture in the central zone of such burners having at least four substantially concentric fuel and primary combustion air feed ducts, while nevertheless ensuring that less than 20% or even less than 10% of the primary air is injected into said central zone; the other at least 80% of the primary air is injected as axial air and as rotary air via the openings of ducts located outside any fuel outlet opening, and said burner has a central stabilizer placed at the outlet of a -central primary air delivery duct, which air opens out through orifices of said stabilizer; said stabilizer projects radially relative to the opening of any tube placed in said central primary air duct and within which fuel can be injected, said central zone being the zone situated ahead of said central stabilizer relative to the nozzle of the burner; according to the invention, the burner has at least one additional gas feed opening out into said stabilizer around said opening at any diameter lying between any tube into which fuel can be injected through the stabilizer and the outer tube defining the central primary air delivery duct.

In a particular embodiment, said additional gas feed is a fourth primary air feed making it possible to favor the mixing of air and fuel in said central zone, the air and fuel mixture in said zone being below the stoichiometric ratio.

In another particular embodiment, said gas feed is an additional fuel gas feed, e.g. natural gas or gas having low calorific power.

When said gas feed is a fourth primary air feed, it can be implemented via an opening placed in said central stabilizer and fed by the central primary air delivery duct without having a specific feed duct proper separate from that for feeding said central primary air.

In a particular embodiment, said fourth primary air feed can be implemented by a peripheral opening disposed around the outer edge of said stabilizer, which opening can either be directly implemented in said central stabilizer without a special duct as mentioned above, and as shown in accompanying FIG. 6, or else it can be defined by the outer tube surrounding said stabilizer and a concentric inner tube; together said two tubes then constitute a feed duct independent of the other primary air feeds.

In other embodiments, adapted either to feeding additional fuel gas or a fourth primary air feed, said additional gas feed is implemented independently of any other gas feed via a concentric tube outside the tube via which any fuel can be injected into the central zone: this is the embodiment which is shown by way of example in most of the accompanying figures.

The result thus makes it possible to obtain an improvement to burners having at least three air feed ducts, including an axial air duct and a rotary air duct disposed concentrically with at least one fuel feed, and a central stabilizer, making it possible to achieve the above-explained object, i.e. enriching the air/fuel mixture more quickly in the central zone of the burner downstream from the stabilizer, either by diminishing the reducing nature of the air/fuel mixture in said zone, or by improving said mixture, or both, while nevertheless conserving the adjustment and operating advantages of the burners to which this improvement is applied, and thus improving the specific qualities thereof.

BRIEF DESCRIPTION OF THE DRAWINGS

The following description and figures show an embodiment of the invention but they are not limiting in any way; other embodiments are possible within the ambit of the scope of the extent of the invention that can be adapted to other types of burner having the main characteristics mentioned above and defined below.

FIGS. 7A to 11 are fragmentary longitudinal half-sections and an end view of the additional gas feed of the invention in various embodiments.

MORE DETAILED DESCRIPTION

Figure 1:
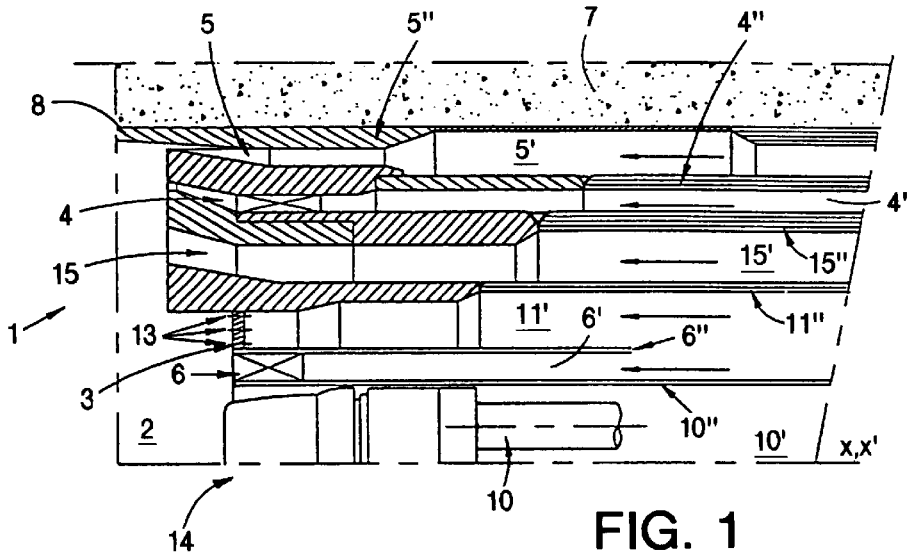
FIG. 1 is a simplified longitudinal half-section of an example of a burner of the invention and used, by way of example of the main application, but not limited thereto, as an improvement to a burner as described in patent EP 421 903.

The present invention thus applies to any burner having at least four substantially concentric ducts 11', 15', 4', and 5' for feeding fuel and primary combustion air, comprising a duct 5' for axial air and a duct 4' for air set into rotation, and a central stabilizer 3 placed at the outlet from a central primary air delivery duct 11' opening out through orifices 13 passing through said stabilizer, said orifices possibly being circular calibrated holes, or slots, or being of any other shape; said stabilizer projects radially relative to any opening 14 of a tube 10" placed in said central primary air duct 11' and into which a fuel can be injected e.g. via a feed pipe 10 for a liquid fuel or for pneumatic transport directly into said duct 10' for any solid fuel in powder form such as powdered combustible waste that is to be incinerated; the assembly comprising said ducts and the stabilizer forms a nozzle 1 about an axis XX'.

Combustion therefore takes place downstream from the outlet of said nozzle 1 around which secondary air is delivered. A general outside view of an example of a complete burner can be seen in FIG. 1 of European patent 421 903.

The nozzle 1 on axis XX' as described in that patent constitutes a preferred embodiment of the burner of the invention: the peripheral outlet orifices 4, 5 of the primary air feed ducts are disposed radially outside all fuel duct outlets 14, 15, whether passing directly via a central duct 11', via a pipe 10 situated in said central duct 11', or via a peripheral duct 15' into which pulverized coal or any gaseous fuel is preferably sent. Said peripheral outlet orifices 4, 5 feed the nozzle 1 with axial air and with swirling air via at least two concentric ducts 4' and 5', and the central duct 11' is partially obstructed by a flame stabilizer 3 in the form of a flange surrounding the opening 14 through which said pipe 10 opens out.

Said flame stabilizer 3 can be a plate whose outside shape is circular, matching the inside shape of the central primary air delivery duct 11': it has orifices or openings 13 for passing a portion of said primary combustion air which together with any air fed via the additional opening(s) 6 in accordance with the present invention represents no more than 20% of said primary air, in such a manner that no significant combustion of the fuel occurs in the central zone 2 situated downstream from said stabilizer 3, which is why said central zone 2 is referred to as a "dead" zone.

The quantity of primary air which is sent into said central dead zone 2 is never zero and preferably lies in the range 0.1% to 20% of the total quantity of primary air, and it is preferably less than 10%, and the proportion of primary combustion air lies in the range 2% to 10% of the total combustion air, and is preferably less than 6%.

The flame stabilizer 3 is preferably offset axially rearwards from the set of concentric openings for primary air and solid or gaseous fuels. The stabilizer 3 is placed at the front ends of the tubes 10" into which fuel can be injected, e.g. via liquid fuel feed pipes 10 which are then slid into said tubes 10".

The axial air outlet opening 5 is situated radially outwards as far as possible from the set of primary air feed ducts and has an outer edge 8 which projects axially forwards and constitutes the inner edge of the hub of the nozzle 1, the outer tube 5" of this duct 5' being itself surrounded by external protective concrete 7.

The axial air outlet orifice 5 is constituted by the ends of the walls of the tubes 4" and 5" and, at least for the inner tube 4", these ends can be conically diverging in shape and can have partitions for steering and splitting said axial air via a plurality of outlet orifices.

The radial air outlet orifice 4 is constituted by the ends of the walls of the tubes 15" and 4" which can likewise be conically diverging in shape, and the orifice has steering partitions to create the turbulent effect in said air being ejected.

In the embodiments shown in FIGS. 1, 2, 3, and 5, the additional gas feed 6 is provided independently of any other gas or air feed via a concentric tube 6" outside the tube 10" within which any fuel can be injected and whose orifice constitutes said opening 14.

Figure 10A:
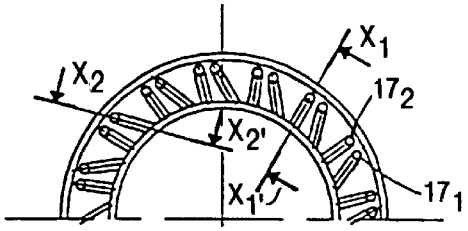
Figure 10B:
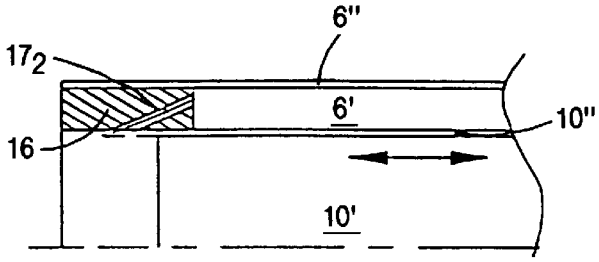
Figure 10C:
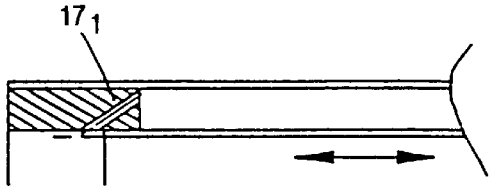
Figure 11:
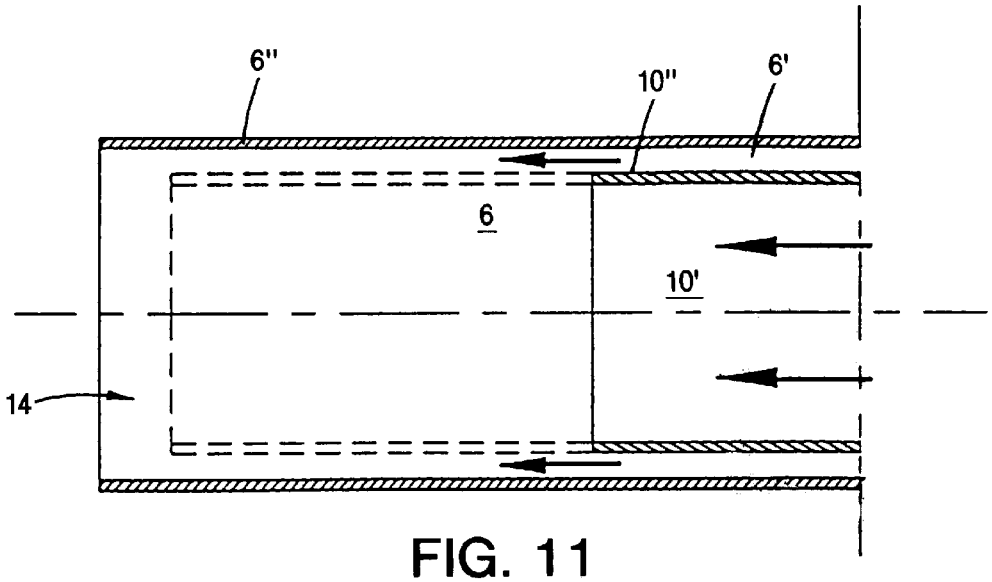

In the embodiments shown in FIGS. 3 and 7 to 11, at least one of the tubes 6" and 10" constituting said additional gas feed duct 6 is movable relative to the other tube. If the inner tube 10" is also set back relative to the tube 6", particularly when powdered solid fuel is injected directly into said tube 10", this fuel is enriched prior to leaving via the orifice 14; this is shown in FIGS. 7 to 11. In FIG. 11 the additional gas feed opening 6 is entirely free, whereas in FIGS. 7 to 10, this opening 6 has devices 9, 16 for at least partially closing said opening:

In FIGS. 7A and 7B the outer tube 61" defining said additional feed duct 6' has an internal end flange 16, as in FIGS. 8; by moving the inner tube 10" forwards to the maximum extent, this flange serves to obstruct said additional opening 6 completely; furthermore, behind the end flange 16 making it possible to obstruct the duct completely, partitions 9 can be placed that are inclined so as to inject the additional gas in guided manner in any desired direction, which direction is in any event convergent towards the inside of the tube 10" and the gas can also be set into rotation.

In the embodiment of FIGS. 8A to 8D, in addition to gas outlet obstruction and steering devices 16 and 9, the end of the additional feed duct 6' can include, behind the partitions 9, a circular peripheral partition 19 surrounding the outer wall 10" of the duct 10' and pierced by radial orifices 18 enabling the additional gas to be injected by pulling back the tube 10" so as to uncover said orifices; in addition, on section VIII–VIII', as shown in FIG. 8C, said peripheral partition 19 can have crenellations in register with or downstream from said orifices 18 so that the gas penetrates preferentially through the orifices 18 when they are uncovered prior to the remainder of the gas being directed through the partitions 9.

In the embodiments shown in FIGS. 9A and 9B, and 10A to 10C, said inner end flange 16 can have inclined gas injection orifices 17 at angles that can be different, as shown particularly in FIGS. 10A to 10C: in particular the section $X_1$–$X'_1$ corresponds to FIG. 10C with a large angle of inclination relative to the axis XX' of the burner, and the section $X_2$–$X'_2$ corresponds to FIG. 10B with a smaller angle of inclination.

These various embodiments and the possibility of the central tube 10" being movable make it possible to obtain various types of adjustment in the injection of additional gas into the fuel fed via the duct 10' for the purposes of optimizing and enhancing subsequent combustion thereof.

Figure 3A:
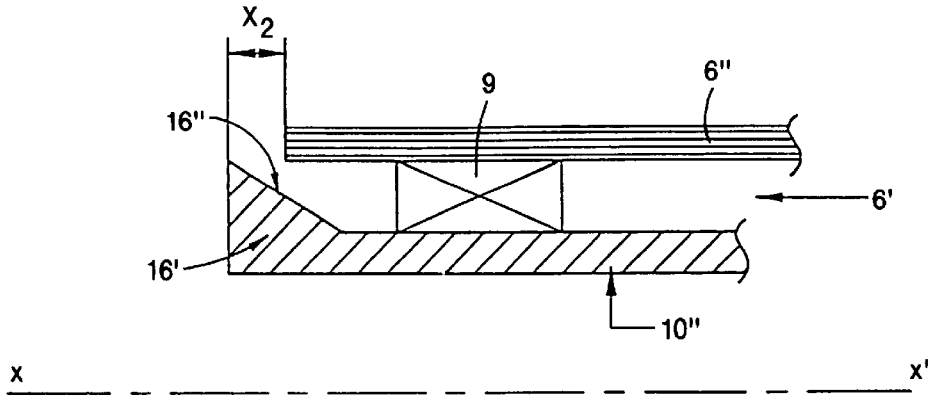
FIGS. 3A and 3B are simplified half-sections restricted to the additional gas feed opening outlet on its own and showing two possible adjustments.
Figure 3B:
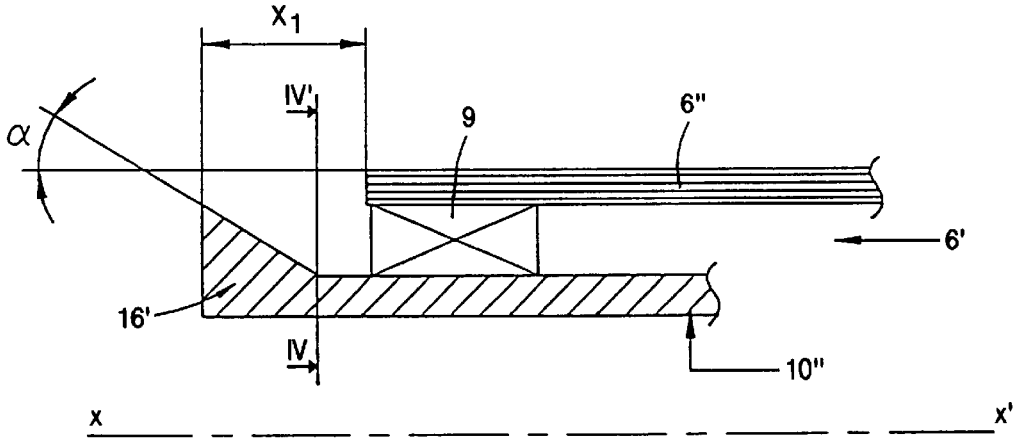
Figure 4:
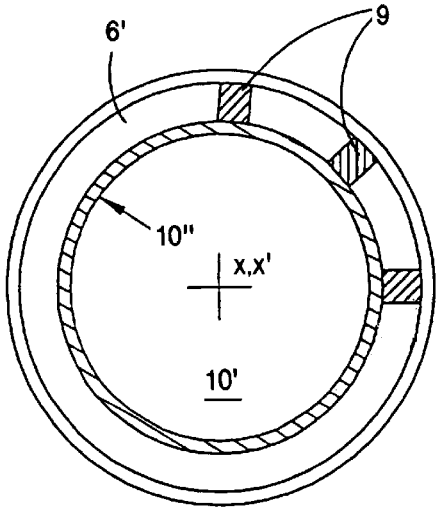
FIG. 4 is an end view of the outlet of said additional feed opening.

In the embodiments of FIGS. 3A and 3B in which it is likewise the outer tube 10" of the duct 10' which is movable, there are placed a steering device 9 and a device 16 for obtaining at least partial obstruction of the opening 6', as can be seen in the end view in section on IV–IV' of FIG. 4 showing the devices inside the duct 6'; said closure devices 9 also make it possible to impart rotary motion to the additional gas feed flow. Furthermore, in this embodiment, the end of the tube 10" has a flange 16' situated downstream from the outer tube 6" and having a surface 16" that constitutes the inner wall of the end of the duct 6' which is of a diverging conical shape, thereby making it possible firstly to steer the gas flow outwards and secondly, by varying the opening X between the respective end edges of the tubes 6" and 10" to cause the flow rate and/or the flow speed of said additional gas injection to vary.

Figure 2:
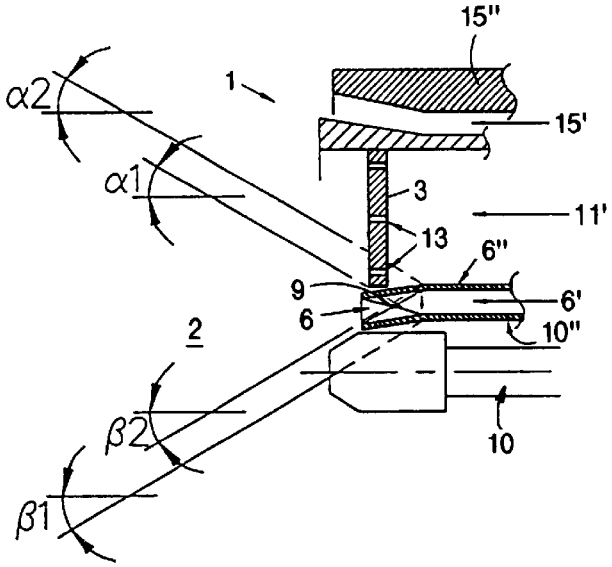
FIG. 2 is a fragmentary half-section of the central portion of the embodiment of the burner shown in FIG. 1 together with an additional feature.
Figure 6:
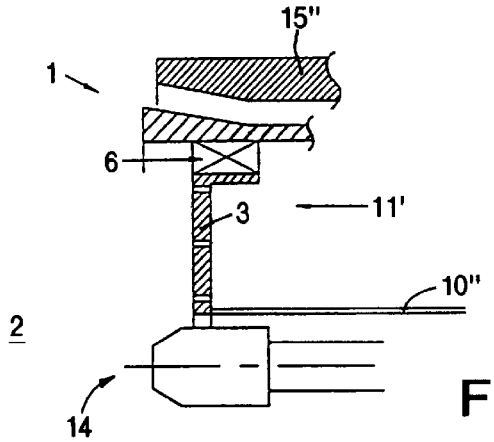
FIG. 6 is a fragmentary half-section of the central portion of a burner of the invention with a single fourth primary air feed situated at the periphery of the stabilizer and defined by the central duct.

In another embodiment as shown in FIG. 2, said additional gas feed opening 6 can be constituted, at least on one side, by the end of a diverging wall of a tube 6", 10", or 11", said end of said wall being in the form of a truncated cone diverging with a half-angle $\alpha$; each of the walls, in this case the walls 6" and 10", can form a different angle, in this case respectively $\alpha 2$ and $\alpha 1$.

Similarly, with an opposite angle opening, said additional gas feed opening 6 can be constituted, at least on one side, by the end of a converging wall of a tube 6", 10", or 11", said end of the wall being in the form of a truncated cone converging with a half-angle $\beta$; the ends of said walls can be at different angles, $\beta 2$ and $\beta 1$.

Figure 5A:
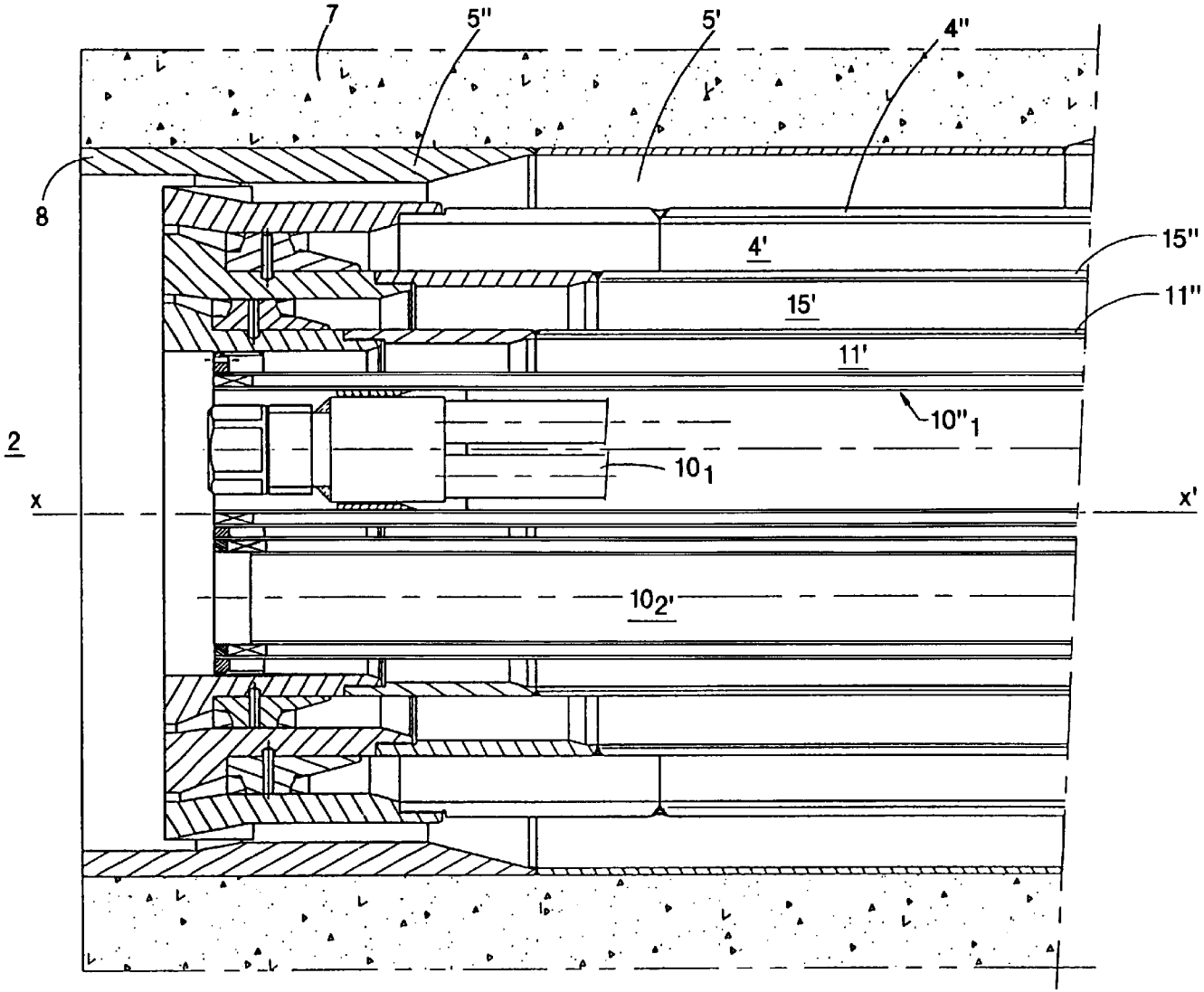
FIGS. 5A and 5B are respectively a longitudinal section and an end view of burners of the invention having a plurality of fuel feed pipes in its central duct.
Figure 5B:
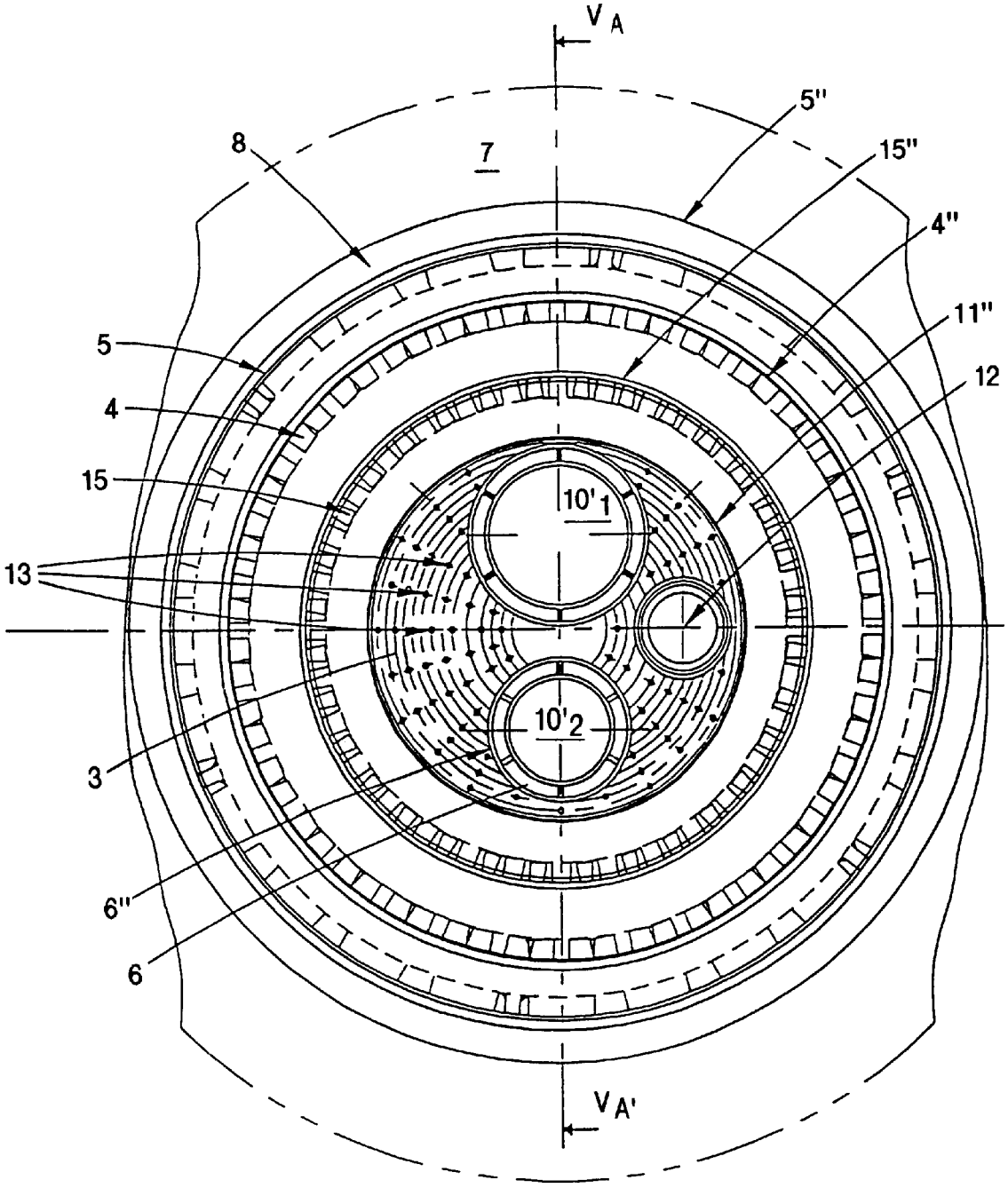

In the embodiments of FIG. 5, the burner can have a plurality of fuel feed ducts in its central portion, passing along the central primary air feed duct 11' and opening out through the stabilizer 3; there can be firstly at least one duct $\mathbf{10}_1$' enabling a liquid fuel feed pipe $\mathbf{10}_1$ to be slid therein, and at least one duct $\mathbf{10}_2$' enabling solid fuel in powder form to be injected directly therein as mentioned above, and finally a duct 12 that constitutes the lighter of the burner for starting combustion of the fuels in the other ducts. In accordance with the invention, said burner can then have as many additional gas feeds 6 as it has said fuel feed ducts 10', 12; each of the ends of said ducts can be fitted with one of the devices shown in FIGS. 2 to 4 and 7 to 11, given that the lighter duct 12 does not have such an additional gas feed duct 6'.

In addition, for the additional gas feed ducts 6', these can contain acid condensables such as $H_2SO_4$ or HCl, so it is important to avoid excessive cooling and condensation of these condensables against the walls of said ducts since that would give rise to corrosion and rapid destruction thereof; to avoid that, said walls can be isolated so as to ensure that they are not cooler than the temperature of the fuel; for this purpose it is possible to isolate either the walls of the primary air guide tubes from the guide tubes of the solid or gaseous fuel circuits, or the walls of those ducts. This thermal insulation can be applied to the side which is not subjected to abrasion by solid fuel or gas, and it can preferably be constituted by a thin-walled protective tube (about 0.5 mm to 2 mm thick) together with either an insulating felt or card paper of very low thermal coefficient and of thickness lying in the range about 2 mm to 15 mm, or else a sprayed-on deposit of a special temperature-withstanding paint having a thermal coefficient that is likewise very small.

The devices of the present invention can be applied to any burner having basic characteristics that are known such as those described in the introduction, and capable of including other peripheral circuits (outside and surrounding the stabilizer 3) for feeding fuel in addition to the pulverized coal which is the only fuel shown in the embodiment taken as an example herein.

What is claimed is:

1. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional air feed opening out into said central stabilizer, said at least one additional air feed being placed around an outer edge of said central stabilizer and forming a fourth primary air feed.

2. A burner according to claim 1, wherein said peripheral duct is defined by a tube surrounding said central stabilizer and a concentric internal tube and wherein said tube surrounding said central stabilizer and said concentric internal tube constitute a fuel feed duct independent of said primary air feeds.

3. A burner according to claim 2, wherein at least one of said tube surrounding said central stabilizer and said concentric internal tube is movable relative to the other of said tube surrounding said central stabilizer and said concentric internal tube.

4. A burner according to claim 1, further comprising a plurality of fuel feed ducts in a central portion, said plurality of fuel feed ducts opening out through said central stabilizer, and a plurality of additional gas feeds equal in number to said plurality of fuel feed ducts.

5. A burner according to claim 1, wherein said at least one additional air feed opening is formed by an opening fed by a primary air delivery duct.

6. A burner according to claim 1, wherein said at least one additional air feed opening is independent of any other air feed as a result of a concentric tube positioned outside the tube placed in said central primary air delivery duct.

7. A burner according to claim 1, wherein said at least one additional air feed opening includes devices for at least partially obstructing said opening.

8. A burner according to claim 1, wherein said at least one additional air feed opening is formed on at least one side by an end of a tube having a diverging wall and said diverging wall end being in the form of a diverging truncated cone.

9. A burner according to claim 1, wherein said at least one additional air feed opening is formed on at least one side by an end of a tube having a converging wall and said converging wall end being in the form of a converging truncated cone.

10. A burner according to claim 1, wherein said at least one additional air feed opening has devices for guided injection of a gas in any desired direction.

11. A burner according to claim 1, wherein said primary air feeds are formed by tubes whose walls are isolated from gas and solid fuel circuits that contain acid condensables.

12. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional gas feed opening out into said central stabilizer, said at least one additional gas feed being placed around an outer edge of said central stabilizer;

said peripheral duct being defined by a tube surrounding said central stabilizer and a concentric internal tube, said tube surrounding said central stabilizer and said concentric internal tube constitute a fuel feed duct independent of said primary air feeds; and at least one of said tube surrounding said central stabilizer and said concentric internal tube being movable relative to the other of said tube surrounding said central stabilizer and said concentric internal tube.

13. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional gas feed opening out into said central stabilizer, said at least one additional gas feed being placed around an outer edge of said central stabilizer; and the at least one additional gas feed opening having devices for at least partially obstructing said opening.

14. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional gas feed opening out into said central stabilizer, said at least one additional gas feed being placed around an outer edge of said central stabilizer; and said at least one additional gas feed opening being constituted, at least on one side, by an end of a diverging wall of a tube, and said end of said diverging wall being in the form of a diverging truncated cone.

15. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional gas feed opening out into said central stabilizer, said at least one additional gas feed being placed around an outer edge of said central stabilizer; and said at least one additional gas feed opening being constituted, at least on one side, by an end of a converging wall of a tube, and said end of the converging wall being in the form of a converging truncated cone.

16. A burner comprising:

at least four substantially concentric ducts for feeding fuel and primary combustion air;

said at least four ducts including an axial air duct, rotary air duct, a central primary air delivery duct, a peripheral duct positioned radially inside the axial air duct and the rotary air duct for receiving fuel which has at least one fuel outlet opening;

said axial air duct, said rotary air duct, and said central primary air delivery duct comprising primary air feeds for said burner;

said axial air duct and said rotary air duct being disposed radially outside said at least one fuel outlet;

a central stabilizer placed at an outlet of said central primary air delivery duct;

said central primary air delivery duct opening out through orifices in said central stabilizer;

a tube placed in said central primary air delivery duct for receiving fuel;

said central stabilizer extending radially relative to an opening of said tube placed in said central primary air delivery duct;

at least one additional gas feed opening out into said central stabilizer, said at least one additional gas feed being placed around an outer edge of said central stabilizer; and the at least one additional gas feed opening having devices for guided injection of gas in any desired direction.

* * * * *

UNITED STATES PATENT AND TRADEMARK OFFICE

CERTIFICATE OF CORRECTION

PATENT NO. : 6,315,551 B1
APPLICATION NO. : 09/566830
DATED : November 13, 2001
INVENTOR(S) : Patrick Salzsieder et al.

It is certified that error appears in the above-identified patent and that said Letters Patent is hereby corrected as shown below:

Title Page; item (54);

In the title, line 1, after "BURNERS HAVING" delete "AT LEAST THREE AIR FEED DUCTS, INCLUDING AN AXIAL AIR DUCT AND A ROTARY AIR DUCT CONCENTRIC WITH AT LEAST ONE FUEL FEED, AND A CENTRAL STABILIZER" and insert
--A FOUR AIR FEED OUTFLOW--.

In column 1, line 1, after "BURNERS HAVING" delete "AT LEAST THREE AIR FEED DUCTS, INCLUDING AN AXIAL AIR DUCT AND A ROTARY AIR DUCT CONCENTRIC WITH AT LEAST ONE FUEL FEED, AND A CENTRAL STABILIZER" and insert
--A FOUR AIR FEED OUTFLOW--.

In column 1, line 50, change "an-orifice" to --an orifice--.

In column 2, line 10, change "-central" to --central--.

In column 5, line 24, change "6'" to --6--.

Signed and Sealed this

Nineteenth Day of February, 2008

JON W. DUDAS
*Director of the United States Patent and Trademark Office*